United States Patent [19]

Berkovitz

[11] 4,039,755

[45] Aug. 2, 1977

[54] AUDITORIUM SIMULATOR ECONOMIZES ON DELAY LINE BANDWIDTH

[75] Inventor: Robert A. Berkovitz, Lexington, Mass.

[73] Assignee: Teledyne, Inc., Los Angeles, Calif.

[21] Appl. No.: 708,576

[22] Filed: July 26, 1976

[51] Int. Cl.[2] ..... H04R 3/00

[52] U.S. Cl. ..... 179/1 G; 179/1 GP; 179/1 J

[58] Field of Search ..... 179/1 AT, 1 GP, 1 G, 179/1 J, 100.1 TD; 360/7

*Primary Examiner*—George G. Stellar

*Attorney, Agent, or Firm*—Schiller & Pandiscio

[57] ABSTRACT

A filter network for use with an acoustic signal reproduction system having at least two, spatially separable, speaker means each capable of reproducing acoustic waves from corresponding electrical signal. The network includes a frequency divider for separating an electrical signal representative of acoustic waves into first and second components, the first component including primarily those audio frequencies, which when acoustically reproduced tend to provide unambiguous binaural phase localization. The second component includes primarily those audio frequencies which when acoustically reproduced tend not to provide unambiguous binaural phase localization. The network also includes structure for delaying the first component for a predetermined period of time to produce a delayed signal so that when the combined first and second components are applied to one of the speaker means and the combined second component and the delayed signal are applied to the other of the speaker means the acoustic field produced tends to simulate spaciousness or ambience of a larger room than the actual listening area.

22 Claims, 8 Drawing Figures

AUDITORIUM SIMULATOR ECONOMIZES ON DELAY LINE BANDWIDTH

This invention relates generally to psychoacoustics and more particularly to the simulation of spaciousness or ambience in acoustic signal reproduction.

Psychoacoustics deals primarily with the manner in which a listener receives and interprets the fluctuations in pressure associates with acoustic signals or sound waves. The range of intensity of acoustic signals between a sound which is barely audible and the loudest that normally can be listened to without appreciable discomfort is about 120 db. The range of frequencies which the ear normally perceives, extends from approximately 20 to over 15,000 Hz, although this range tends to vary with individual listeners. In addition to the ability to respond to sounds of different intensities and frequencies, human listeners are also capable of localization of sound, i.e. listeners can determine the direction and in some cases even estimate the distance of a sound source.

Two factors primarily assist a listener to determine the direction of a source of sound waves;

1. at certain relatively low frequencies, i.e. between about 200 Hz and about 1500 Hz for the average listener, the difference in time between the arrivals of a wave at the left and right ears (this phenomenon hereinafter referred to as "binaural time displacement") and a. at higher frequencies above about 1500 Hz for the average listener, the relative intensity of the waves received in the left and right ears (this phenomenon hereinafter referred to as "binaural intensity difference").

For an acoustic signal at low frequencies (considered hereinafter to be about between 200 and about 1500 Hz for the average listener), a phase difference caused by waves arriving at the right and left ears at different times, can usually be recognized and from such phase difference one can deduce the direction of the signal. At high frequencies (considered hereinafter to be above about 1500 Hz for the average listener) however, the perception of phase difference of an acoustic wave becomes unreliable since the difference in arrival times of the wave at the two ears is such that the phase difference perceived is usually greater than 360°. Thus, at high frequencies, second and/or subsequent cycles of a wave can arrive at one ear while the first cycle is still on its way to the other ear, causing an ambiguity when this time displacement phenomenon is relied upon for localization. When the acoustic wave is of a very low frequency, (considered hereinafter to be below about 200 Hz for the average listener), the direction of the wave will be difficult to perceive, since the difference in arrival of the wave at the two ears is such that any perceived phase difference is comparatively small.

Further, the size of the human head, which is relatively small compared to the wavelengths of low and very low frequency sounds, precludes a significant difference in intensity at the two ears for sound sources at a distance from the listener. However, at frequencies above about 1500 Hz, the listener's head casts a distinct sound shadow, and the intensity of the sound received by the ear more nearly directed towards the source is normally considerably greater than that in the opposite ear, making binaural intensity difference localization possible.

When these psychoacoustical effects are experienced in a large, enclosed space, such as a concert hall, the location of the source is readily determined by a listener. In addition to cues from the source, reflections which are delayed and displaced with respect to the direct sound, produce a characteristic sensation of ambience or spaciousness. Usually, each concert hall produces its own pattern of reflections, which in turn is heard differently by listeners in different parts of the concert hall auditorium.

It is a primary object of the present invention therefore to create these spatial or ambience effects in acoustic signal reproduction.

More specifically, it is the object of the present invention to simulate the audible spatial and temporal patterns in the discrete early reflection sequences of halls and listening rooms of various dimensions and to present such patterns to listeners by use of a simple, inexpensive delay network system which can easily be incorporated into existing acoustic signal reproduction systems.

Still another object of the present invention is to provide an inexpensive acoustic signal reproduction system for simulating ambience or spaciousness, which system utilizes inconspicuous speaker systems, which can be easily incorporated into domestic environments.

These and other objects of the present invention are achieved by a filter network system for use with an acoustic signal reproduction system having within an enclosed listening space at least two, spatially separated speaker means for reproducing acoustic waves from corresponding electrical signals. The network system generally provides output electrical signals to drive at least one of the speaker means of the reproduction system so that when the other of the speaker means is simultaneously driven by other electrical signals, said two speaker means produce acoustic waves which tend to simulate the ambience of a space larger than the actual enclosed listening space. The network system comprises frequency divider means for separating the input electrical signal derived from the other electrical signals, into first and second compartments, the first component including primarily those audio frequencies which when reproduced acoustically, provide a binaural time displacement which tends to be unambiguously perceived by a listener and the second component comprising primarily those audio frequencies which when reproduced acoustically provide a binaural time displacement which tends not to be unambiguously perceived by the listener. The system also comprises means for delaying for a predetermined period of time the first component with respect to the second component to provide a time delayed signal and means for combining the time delayed signal and the second component to provide a second electrical signal as the output electrical signal of the network system.

Other objects of the invention will in part be obvious and will in part appear hereinafter. The invention accordingly comprises in apparatus possessing the construction, combination of elements, and arrangement of parts and the method comprising the several steps, the order and arrangement thereof, all as exemplified in the following detailed disclosure, and the scope of the application of which will be indicated in the claims.

For a fuller understanding of the nature and objects of the present invention, reference should be had to the following detailed description taken in connection with the accompanying drawings wherein.

In the drawings, like numerals refer to like parts.

Figure 1:
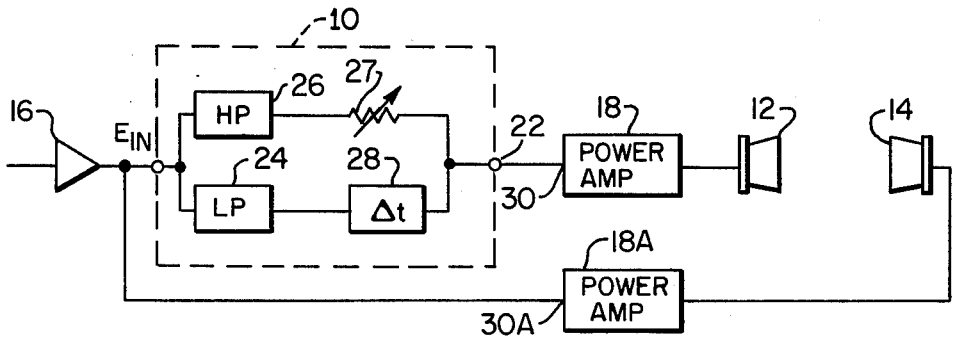
FIG. 1 is a schematic diagram illustrating one embodiment of a network system made in accordance with the present invention used with an acoustic signal reproduction system.

Referring to FIG. 1 of the drawings, the illustrated filter network 10, made in accordance with the present invention, is useful with any acoustic signal reproduction system having at least two spatially separated speaker means 12 and 14. The acoustic signal reproduction system can be any of several types of systems known in the art, such as binaural, stereophonic or quadraphonic systems. Speaker means 12 and 14 may be any type of known audio reproduction speaker means each having one or more speakers which are capable of reproducing acoustic waves over a predetermined spectral range from corresponding electrical signals processed by the reproduction system. Each speaker means includes one or more speakers capable of reproducing acoustic waves in the frequency range of at least 200–1500 Hz, and can also include a woofer (low range speaker capable of providing acoustic waves for purposes of this invention in the frequency range from 0–200 Hz) and/or a tweeter (high range speaker capable of providing acoustic waves for purposes of this invention in the frequency range of 1500 Hz and up) depending on the nature of the reproduction system, the spectral response desired, and the total number of speaker means employed, as will be more evident hereinafter. The reproduction system also typically includes preamplifier 16 for providing a low level electrical signal Ein representative of the program input and power amplifier stages 18 and 18A which, prior to the present invention, amplify the output electrical signals from preamplifier 16 in order to drive the corresponding speaker means 12 and 14 in a manner well known in the art.

In accordance with the present invention, network 10 is preferably connected into the reproduction system so as to receive at its input terminal 20 the electrical signal Ein from the output of preamplifier 16, with its output terminal 22 connected to the input of amplifier stage 18. Alternatively, network 10 can be connected between the output of amplifier stage 18 and the input to speaker 12.

Input terminal 20 of the filter network is connected to means for separating Ein into two components, the first of which primarily includes those audio frequency electrical signals which when reproduced acoustically provide binaural time displacement which tends to be unambiguously perceived by a listener, and the second of which primarily includes those audio frequency electrical signals which when reproduced acoustically provide binaural time displacement which tends to be ambiguous.

The means for separating Ein into these two components preferably includes low pass filter 24 for passing only the first component and high pass filter 26 for passing only the second component. Low pass, and high pass filters are well known in the art with low pass filter 24, and high pass filter 26 preferably being respectively designed to pass substantially only those audio frequency portions of energy below about 1500 Hz, and above about 1500 Hz, respectively. The low pass and high pass filters are connected in parallel with their inputs jointly coupled in common to input terminal 20, the output of filter 26 being connected to the output terminal 22 of network 10 through means, in the form of variable resistor 27, for adjusting the amplitude of the filter 26 in order to maintain a spectral balance. The output of low pass filter 24 is connected to output terminal 22 through means 28 for temporally delaying the output of filter 24 with respect to the output of filter 26. Means 28 may be any type of device which will temporally delay the signal while maintaining its spectral purity, and preferably is a delay line capable of providing from zero to at least 100 millisecond delays at very low and low audio frequencies, (i.e., between 0 and about 1500 Hz). Such delay lines are well known in the art and can provide a predetermined delay or can include means for varying the amount of delay desired. For example, the delay lines may be charge coupled, analog shift registers of the type known as SAD 1024 manufactured by Reticon Corporation, a corporation doing business in California. Such devices may also be digital shift registers or random-access memory devices, connected to appropriate conversion or encoding devices at their input and output, or any other similar device known in the art. These devices generally employ analog-to-digital conversion sampling techniques in a manner well known in the art, and usually the amount of storage required to accomplish such a conversion is a function of the bandwidth of the signal stored. Thus, where the bandwidth of the output of low pass filter 24 is between about 0–1500 Hz, about 3000 bits of storage might be sufficient to produce delays of the order of 100 milliseconds.

In order to utilize network 10 in accordance with the present invention the output of preamplifier 16 is connected directly to the input 30A of power amplifier stage 18A and to input terminal 20 of network 10. The output terminal 22 of network 10 is connected to input 30 of power amplifier 18. The signal Ein is thus separated into a pair of signals having substantially like frequency characteristics, the first of the pair being applied to input terminal 20 of network 10, while the second is applied directly to the input 30A of power amplifier 18A. The first signal applied to network 10 is separated into first and second components by filters 24 and 26, respectively.

Means 28 introduces a time delay of the component transmitted through filter 24. The combined signal at the output of network 10 and applied to input terminal 30 of amplifier stage 18 thus, has substantially the same spectral content as the signal applied to input 30A of amplifier stage 18A except that the spectral portions of the signal delayed by means 28 are delayed with respect to the corresponding spectral portions of the signal applied to input 30A of amplifier 18A. The output of amplifier 18 drives speaker means 14 so that this delay provides a time displacement in the same frequency range of the acoustic waves produced by the speaker means 12 and 14 as those frequencies delayed by means 28. Thus, a listener positioned near the speaker means 12 and 14 will perceive this time displacement as existing within the frequency range where binaural time displacement is normally perceivable, simulating or creating a greater sense of ambience or spaciousness of the listening area than might be achieved without such added time displacement.

Figure 2:
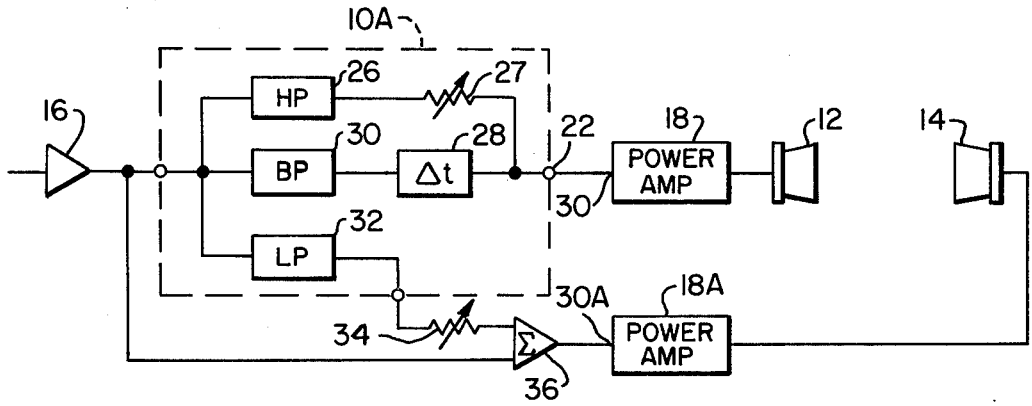
FIG. 2 is a schematic diagram illustrating another embodiment of a network system made in accordance with the present invention used with an acoustic signal reproduction system.

It will be recognized that since the dynamic range requirement is an important determinant of cost of an audio delay those frequencies normally requiring the greatest dynamic range are often those below 200 Hz, so that by omitting these from the delay path, on the grounds that their direction could not be sensed in any case, also will usually reduce the dynamic range of the program. Accordingly, network 10 can be modified as shown in FIG. 2, in order to further reduce the bandwidth requirements, and thus the costs of delay line 28. In this embodiment network 10 is modified so that the low pass filter 24 is replaced with bandpass filter 30 and low pass filter 32. Bandpass filter 30 and low pass filter 32 are well known in the art with bandpass filter 30 and low pass filter 32 preferably being designed to pass substantially only those audio frequency portions of the energy of Ein between about 200 and 1500 Hz and below about 200 Hz, respectively. In this embodiment, the filters 26, 30 and 32 are all connected with their inputs jointly coupled in common to input terminal 20. The output of filter 26 is connected through variable resistor 27 to output terminal 22 of network 10A and the output of filter 30 is connected to the input of delay line 28. Since bandpass filter 30 only transmits those frequencies between about 200 and about 1500 Hz, the bandwidth and dynamic range requirements of delay line 28 are minimal.

The output of low pass filter 32 can be connected to the output terminal 22 of network 10A when speaker means 12 has a frequency response which includes those frequencies below about 200 Hz. Preferably, however, the output of filter 32 is connected to means 34, such as a variable resistor, for controlling the level of the output of filter 32. Means 34 is connected in turn to a buffer or summing amplifier 36 which adds the output of filter 32 as modified by means 34 to the signal provided from preamplifier 16. This summed signal is then applied to input 30A of power amplifier 18A. As will be more evident hereinafter, this preferred arrangement of connecting the output of low pass filter 32 through means 34 and summing amplifier 36 to the input 30A of amplifier stage 18A, reduces the required frequency response of speaker means 12 so as to reduce the cost of the latter. Further, by properly adjusting means 34, spectral balance of the acoustic signals provided by speaker means 12 and 14 is maintained.

Figure 3:
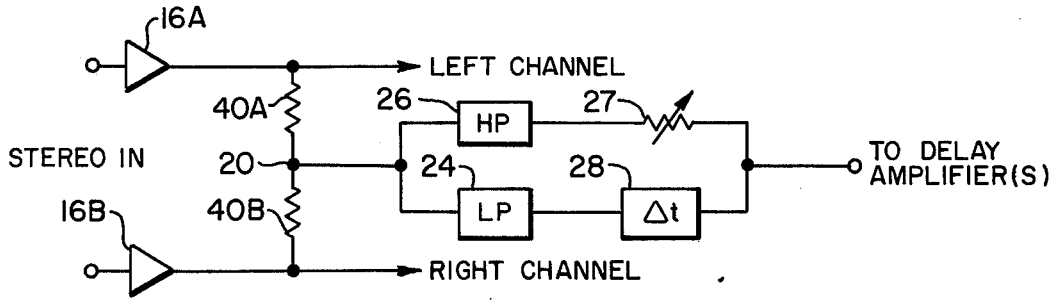
FIG. 3 is a schematic diagram illustrating the FIG. 1 embodiment as used with a stereophonic reproduction system.

As previously described, the signal reproduction system with which network 10 (or 10A) is used can be any of several types of systems known in the art. Accordingly, the electrical signal, Ein, applied to input terminal 20 can be any type of audio signal, such as monoaural; the left, right or the monoaural sum of mixed left and right channel sterophonic signals; one a mixture of two, or the monoaural sum of four decoded quadraphonic channel signals or the like. For example, referring to FIG. 3, network 10 is shown connected into a conventional sterophonic system having separate left and right channel signals.

More specifically, a typical stereophonic reproduction system includes left and right channel preamplifiers 16A and 16B for shaping the incoming signals from the left and right channels, left and right power amplifier stages (not shown) for amplifying the outputs of preamplifiers 16A and 16B, respectively, which in turn drive corresponding left and right speaker means (not shown). The outputs of preamplifiers 16A and 16B are mixed, such as through resistances 40A and 40B, to provide a monoaural summation of the two channel signals before being applied to input terminal 20 of network 10 (or 10A). The output of network 10 is then applied to power amplifier (not shown) in accordance with the present invention which amplifier in turn drives separate speaker means (not shown) so as to simulate ambience or spaciousness.

The illusion of spaciousness provided by network 10 is even more perceivable, when several speaker means are utilized to introduce more than one delay to simulate the successive early reflections of an attack transient as perceived or measured in the acoustic field of a concert hall. This can be accomplished by utilizing a separate network 10 (or 10A) for each delay desired. The output of each network 10 (or 10A) is connected to the particular speaker means from which a particular delay is desired. Preferably, however, network 10 (or 10A) can be modified so as to include plural delay means, or plural output taps at various locations in a single delay path, each delay means or tap providing a predetermined delay.

Figure 4:
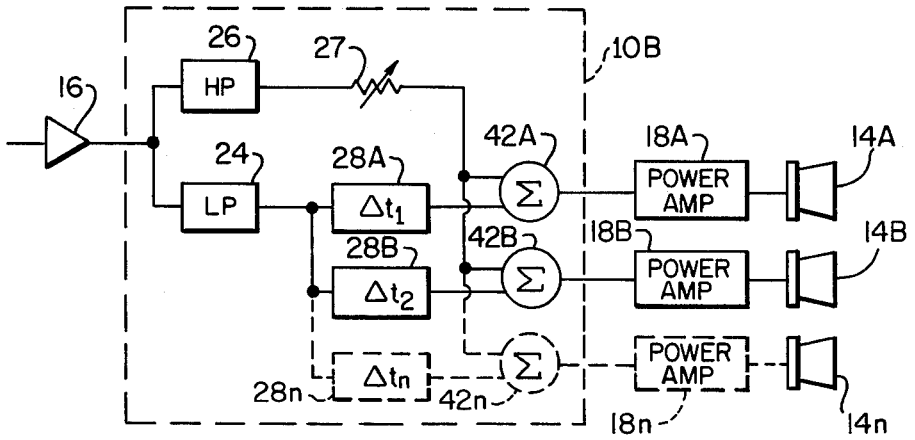
FIG. 4 is a schematic diagram illustrating a third embodiment of the present invention used with an acoustic signal reproduction system.

More particularly, referring to FIG. 4, network 10B is shown modified so as to provide a plurality of signals having their low frequency components delayed for predetermined period of time relative to one another. Network 10B is the same as network 10 except that one or more delay means 28 have been added. Specifically, the output of low pass filter 24 is connected to the input of each means 28A, 28B . . . 28n (the number of delay means being a matter of choice depending on the design of the system). The delay means are connected in parallel so that the output of each delay means 28A, 28B . . . 28n added with the output of high pass filter 26 (the latter being adjusted by variation of resistor 27) through a corresponding summing junction 42A, 42B . . . 42n. Each summing junction may be any type of device for adding the two input signals at the output while isolating the two inputs from one another so as to prevent feedback. Such devices are well known in the art and may include an isolation amplifier or the like.

The output of junctions 42A, 42B . . . 42n are connected to power amplifiers 18A, 18B . . . 18n, respectively, for driving the corresponding speaker means 14A, 14B . . . 14n. The output of speaker means 14A, 14B . . . 14n, are acoustic signals all having their high frequency components in phase with one another, while the low frequency component of each signal is time delayed with respect to the corresponding low frequency components of the other signals. For example, where means 28A and 28B introduce 25 and 50 millisecond delays, respectively, the low frequency component of the acoustic signals of the output of speaker means 14A and 14B will be time delayed 25 and 50 milliseconds, respectively, with respect to the high frequency components.

Figure 5:
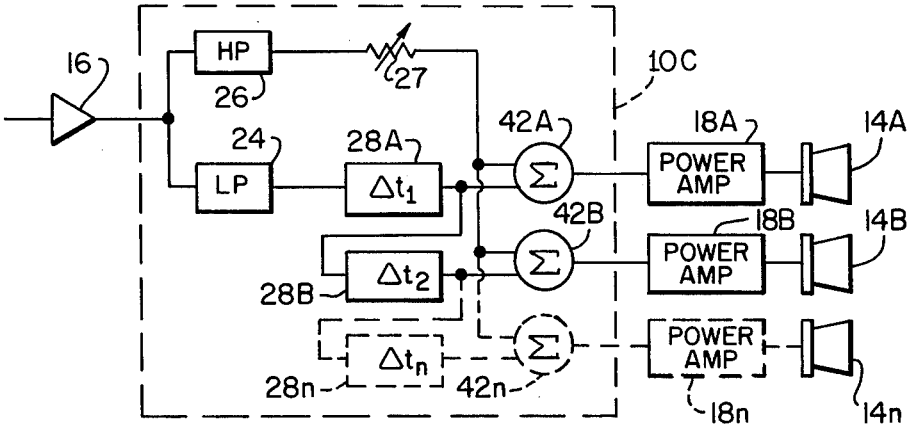
FIG. 5 is a schematic diagram of a fourth embodiment of the present invention used with an acoustic signal reproduction system.

The delay means 28 can also be connected in a series arrangement. For example, as shown in FIG. 5, network 10C is identical to network 10B except that the delay means 28 are connected in a series or additive arrangement. Specifically, the output of low pass filter 24 is connected only to the input of delay means 28A. The output of delay means is connected to an input of summing junction 42A and to the input of delay means 28B. The output of the latter is connected to an input of summing junction 42B, and to the input of the next delay means, etc. With this series arrangement if each delay means introduces a 10 millisecond delay, the low frequency component of the output of speaker means 14A will be delayed 10 milliseconds with respect to its high frequency component, the low frequency component of the output of speaker means 14B will be delayed 20 milliseconds, etc.

Figure 6:
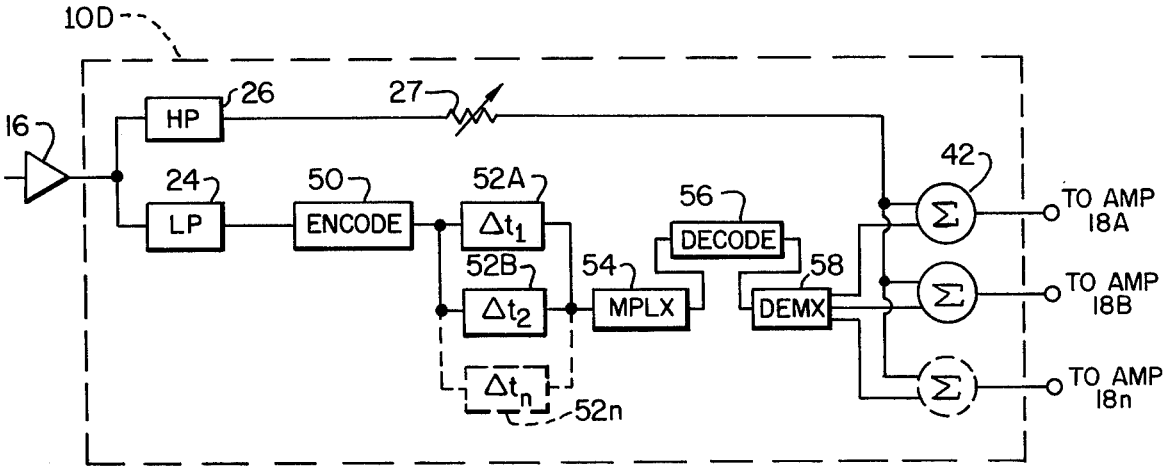
FIG. 6 is a schematic diagram of a fifth embodiment of the present invention used with an acoustic signal reproduction system.

The use of a series or parallel arrangement of the delay means 28, as illustrated in FIGS. 4 and 5, may be preferred over the use of a separate network for each delay, since only one high pass and low pass filter need be employed for the entire system which may reduce the costs of the overall system. However, a substantial portion of the costs of the network resides in the delay means, particularly where an analog delay line is used. Such devices usually encode the signal, by analog-to-digital conversion, delay the encoded signal and then decode the signal by digital-to-analog conversion. Usually, a major cost factor of such devices is in the encoding and decoding process. Accordingly, in order to further reduce the costs of the network where multiple delays are desired, the network 10 (or 10A) can be further modified as shown in FIG. 6.

The output of low pass filter 24 (or bandpass filter 30) is encoded by encoder 50, such as an analog-to-digital converter and then delayed over lines 52, connected together either in a parallel arrangement as shown, or in a series arrangement. The output of each delay line 52A, 52B, etc., is connected to the input of a time-division multiplexor 54. The latter is a device well known in the art. Generally, the multiplexor sequentially allocates different time intervals for the transmission of each signal provided at the output of the delay lines 52 so that each signal can be independently transmitted over a common transmitting medium and received while preserving the information contained in each signal. Each signal can then be decoded by a common digital-to-analog converter 56, whereupon the signals can be sorted by the demultiplexor 58. The latter provides a plurality of outputs which correspond to the individual signals originally delayed by each delay line 52 and multiplexed by multiplexor 54. The outputs of demultiplexor 58 are combined with the output of high pass filter 26 in a manner previously described so as to drive the individual power amplifiers 18A, 18B, etc., which in turn drive the individual speaker means.

Figure 7:
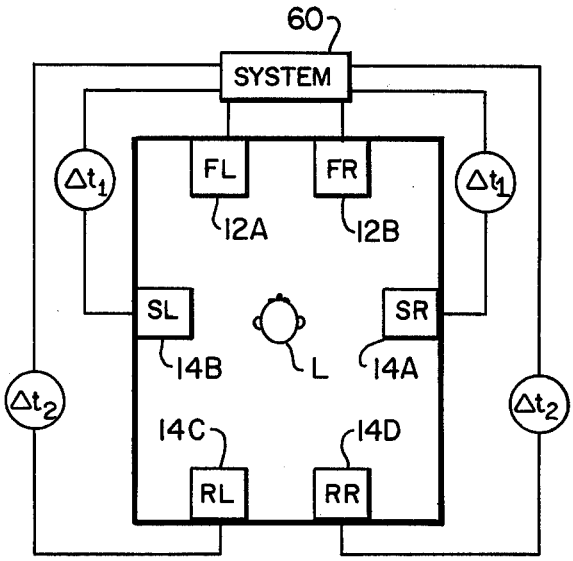
FIG. 7 is a schematic diagram of a listening area illustrating the speaker placement of an acoustic signal reproduction system utilizing the principles of the present invention.
Figure 8:
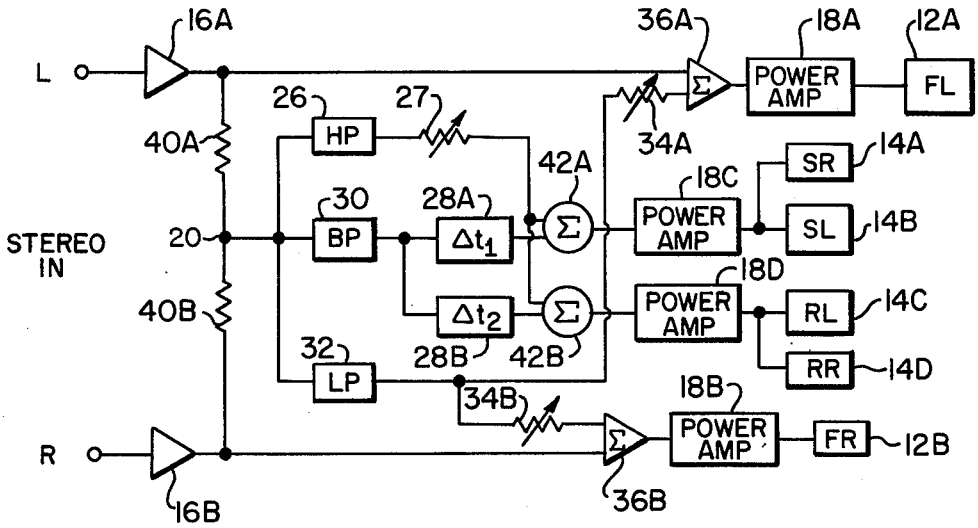
FIG. 8 is a schematic diagram illustrating an example of the component parts of the FIG. 7 system.

An example of a system employing the teachings of the present invention are shown and described in FIGS. 7 and 8. As shown, the present invention is employed with a stereophonic audio system 60 having left and right channels for carrying left and right channel signals, L and R respectively. In a manner well known in the art, and as previously described in reference to FIG. 3, the signals L and R respectively drive the left and right channel speaker means (FL and FR) 12A and 12B, the latter being placed respectively to the listener's (L) front left and front right. Generally, as shown in FIG. 8, system 60 includes left and right channel preamplifiers 16A and 16B for shaping the incoming signals from the corresponding left and right channels, and power amplifier stages 18A and 18B for amplifying the outputs of preamplifiers 16A and 16B, respectively. The outputs of amplifiers 18A and 18B are used to drive the corresponding left front and right front speaker means, 12A and 12B, respectively. The speaker means 12A and 12B include low, middle and high frequency range speakers in order to provide acoustic waves over a wide spectral range. In accordance with the present invention, system 60 is modified to include network 10E, and power amplifier stages 18C and 18D. Stage 18C is connected to drive both the auxiliary right and left side speaker means (SR and SL) 14A and 14B (placed respectively to the listener's right and left side) with a time delay of $\Delta t_1$ of the low frequency components, while stage 18D is used to drive both the auxiliary left and right rear speaker means (RL and RR) 14C and 14D (placed respectively behind the listener, to his left and right side) with a time delay $\Delta t_2$ of the low frequency components.

More specifically, the stereophonic system is modified so that the output signals of preamplifiers 16A and 16B are combined through resistances 40A and 40B and applied as a mixed monaural signal to the input of network 10E. The network includes the low pass, bandpass and high pass filters 32, 30 and 26, with the output of the bandpass filter being applied to the inputs of two parallel delay lines 28A and 28B, which introduce a signal time delay of $\Delta t_1$, and $\Delta t_2$, respectively.

The output of delay lines 28A and 28B are connected to inputs of summing junction 42A and 42B, respectively. The other inputs of the junctions are connected to the output of highpass filter 26 through the variable resistor 27, so that the output of junctions 42A and 42B includes the high frequency component passed by filter 26 and a delayed low frequency component the time delay of which is dependent on the delay introduced by the particular delay line. The output of junctions 42A and 42B thus includes the high frequency portions of the mixed monaural signal applied to input terminal 20, and low frequency portions, between about 200–1500 Hz out of phase with the corresponding frequency portions appearing in the left and right channels. The outputs of junctions 42A and 42B are applied to power amplifiers 18C and 18D which in turn drive the side and rear speakers, respectively.

The outputs of the side and rear speakers produce acoustic signals, in the low and high frequency ranges with the low frequency portions (between about 200–1500 Hz) produced by the side speakers, SL and SR, and the rear speakers RL and RR, being out of phase with one another as well as with the corresponding low frequency portions of the acoustic signal produced by the front speakers. One example of the time delay introduced by the delay lines 28A and 28B of network 10E are 30 and 60 milliseconds, although this may vary.

In this embodiment, the auxiliary side and rear speaker means, SL, SR, RL, RR, produce acoustic signals only in the low and high frequencies, thus making it unnecessary to employ woofer speakers in the auxiliary speaker means, making the latter less expensive as well as smaller in size so that they can more easily fit in normal domestic environments. However, the side and rear speaker means present a greater intensity of the low and high frequency portions of the acoustic signals to the listener without a comparable increase in the very low frequency portions (i.e., between zero and about 200 Hz). In order to achieve spectral balance in the listening area, the output of low pass filter 32 is connected through variable resistors 34A and 34B to inputs of summing amplifiers 36A and 36B, respectively. The latter sum the output of filter 32 as applied through the particular resistor 34A or 34B with the left and right channel signals. The outputs of amplifiers 36A and 36B are connected to the inputs of power amplifiers 18A and 18B, respectively. Resistors 34A and 34B and summing amplifiers 36A and 36B cooperate to amplify the low frequency portions of the left and right channel signals so that when amplifiers 18A and 18B drive the front speaker means, the base response of the latter is enhanced. By properly adjusting the resistances 27, 34A and 34B, spectral balance of the acoustic signal can be achieved.

It will be appreciated that the time delay of the low frequency components of the acoustic signals provided by the signals of the side speakers is less than the time delay of the corresponding signals provided by the signals of the rear speakers so as to simulate an actual acoustic field provided by a source in the front of a larger area where binaural time displacement is experienced.

Creating binaural time displacements in accordance with the present invention only with respect to the low frequency portions of acoustic signals similar to those encountered in assembly or concert halls in order to simulate spaciousness or ambience has several advantages.

Delaying the high frequency portions of the signal as well as the low frequency portions of the signal, will create some high frequency noise and distortion of the acoustic signal subsequently produced. More importantly, although it is desirable for the acoustic waves produced to have as much spectral content as possible so as to provide a minimum strain to the listener, delaying the entire spectral content of the signal is costly and complex. The present invention simplifies and reduces the cost of simulating ambience or spaciousness of a larger listening area than the one in which the listener is positioned, by reducing the banwidth of the portion of the electrical signal delayed to a frequency range having an unambiguous effect on binaural phase localization, i.e., frequencies below about 1500 Hz and then mixing this delayed of the signal with the higher frequencies.

By reducing the bandwidth requirements of the delay, the storage requirements and the costs of delaying the low frequency portions of the signal are reduced, while the low frequency dynamic range can be maintained. Further, the low frequency delays can easily be accomplished by analog-digital-analog conversion techniques.

It will be recognized that although the upper frequency limit of about 1500 Hz has been used throughout the specification to describe the phenomenon of binaural phase localization and binaural time displacement as a cutoff frequency for the filters of networks 10, 10A, 10B, 10C, 10D and 10E, 1500 Hz is a nominal or recommended average frequency, and that somewhat higher or lower cut off frequencies may be employed (to as low as 400 Hz or as high as 4000 Hz) without substantially altering the effect obtained although the purity of the resulting effect and the listener's appreciation of the result will be adversely affected by such a modification of the recommended cut off frequency.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. For use with an acoustic signal reproduction system having within an enclosed listening space at least two spatially separated speaker means for reproducing acoustic waves from corresponding electrical signals, apparatus for providing output electrical signals to drive one of said speaker means so that when the other of said speaker means is simultaneously driven by other electrical signals, said speaker means produce acoustic waves which tend to simulate the ambience of a space larger than the actual enclosed listening space, the input electrical signals for said apparatus being derived from said other signals; said apparatus comprising, in combination:

means for separating each of said input electrical signal into first and second components so that said first component includes primarily those audio frequencies, which when reproduced acoustically provide a binaural time displacement which tends to be unambiguously perceived by a listener, and said second component includes primarily those audio frequencies which when acoustically reproduced provide a binaural time displacement which does not tend to be unambiguously perceived by said listener, means for delaying for a predetermined period of time said first component with respect to said second component so as to provide a time-delayed signal; and means for combining said time-delayed signal with said second component to provide a combined signal as said output electrical signal of said apparatus.

2. Apparatus in accordance with claim 1 wherein said means for separating includes low pass filter means for separating said first component from said input signal.

3. Apparatus in accordance with claim 2, wherein said first component includes primarily those audio frequencies in the range between about 200 Hz and about 1500 Hz.

4. Apparatus in accordance with claim 2 wherein said second component primarily includes only those audio frequencies which when acoustically reproduced provide binaural time displacement which tends to be ambiguously perceived by said listener.

5. Apparatus in accordance with claim 4, wherein said means for separating also includes high pass filter means for separating said second component from said input signal.

6. Apparatus in accordance with claim 5 wherein said second component includes primarily those audio frequencies in the range above about 1500 Hz.

7. Apparatus in accordance with claim 1 wherein said means for separating includes bandpass filter means for passing said first component and said second component primarily includes those audio frequencies which when acoustically reproduced provide binaural time displacement which tends to be imperceivable or tends to be ambiguously perceived by said listener.

8. Apparatus in accordance with claim 7 wherein said means for separating includes low and high pass filter means for passing said second component.

9. Apparatus in accordance with claim 8 wherein said first component includes those audio frequencies between about 200 and 1500 Hz and said second component includes those audio frequencies below about 200 Hz and above about 1500 Hz.

10. Apparatus in accordance with claim 1 wherein said predetermined period of time varies between about zero and 100 milliseconds.

11. Apparatus in accordance with claim 1, wherein said means for separating said input signal includes bandpass filter means for passing said first component, high pass filter means for passing said second component and low pass filter means for passing a third component.

12. Apparatus in accordance with claim 11, wherein said third component primarily includes those audio frequencies which when acoustically reproduced provide binaural time displacement which tends to be imperceivable, said apparatus, further including means for simultaneously driving said other speaker means with said other electrical signals and said third component.

13. Apparatus in accordance with claim 12, further including means for maintaining the spectral balance of the acoustic output signals of said speaker means.

14. For use with an acoustic signal reproduction system having within an enclosed listening space, a plurality of spatially separated speaker means for reproducing acoustic waves from corresponding electrical signals, apparatus for providing a plurality of output electrical signals to drive at least a corresponding plurality of said speaker means so that when at least one other speaker means simultaneously driven by other electrical signals, said speaker means produce acoustic waves which tend to simulate the ambience of a space larger than the actual enclosed listening space, the input signal for said apparatus, being derived from said other signals; said apparatus comprising in combination:

means for separating an input electrical signal into first and second components, said first component including primarily those audio frequencies, which when reproduced acoustically provide a binaural time displacement which tends to be unambiguously perceived by a listener, and said second component including primarily those audio frequencies which when acoustically reproduced provide a binarual time displacement, which does not tend to be unambiguously perceived by said listener, means for delaying for a predetermined period of time said first component with respect to said second component so as to provide a plurality of time delayed signals; and means for combining each of said time delayed signals with said second component to provide a corresponding plurality of combined signals as said plurality of output electrical signals.

15. Apparatus in accordance with claim 14, wherein said means for delaying incudes a plurality of delay lines for delaying said first component for a corresponding number of predetermined time periods to provide each of said delay signals.

16. Apparatus in accordance with claim 15, wherein said delay lines are connected in parallel arrangement.

17. Apparatus in accordance with claim 15, wherein said delay lines are connected in series arrangement.

18. Apparatus in accordance with claim 15, wherein said means for delaying further includes means for encoding said component, means for multiplexing each of said delay signals, means for decoding said delay signals and means for demultiplexing said decoded delay signals.

19. Apparatus in accordance with claim 1, wherein said other electrical signals include left and right channel stereophonic signals and said input signal to said apparatus is the monaural mixed sum of said stereophonic signals.

20. A system for reproducing acoustic waves from corresponding electrical signals so as to simulate to a listener the ambience of a space larger than the actual enclosed listening space, said system comprising, in combination:

means for separating an input electrical signal into first and second components, said first component including primarily those audio frequencies, which when reproduced acoustically provide a binaural time displacement which can be unambiguously perceived by said listener, said second component comprising primarily those audio frequencies which when reproduced acoustically provide a binaural time displacement, the perception of which by said listener tends not to be unambiguous;

means for delaying for a predetermined period of time said first component with respect to said second component so as to provide a delayed signal;

means for combining said time delayed signal with said second component to provide a combined signal, and a loudspeaker system having first and second spatially separable speaker means, said first speaker means connected to be driven by said combined signal and said second speaker means connected to be driven by said combined signal.

21. A stereophonic system for reproducing acoustic waves from corresponding electrical left and right channel signals so as to simulate to the listener the ambience of a room larger than the actual enclosed listening space, said system comprising, in combination:

means for mixing said left and right channel signals so as to provide a monaural input signal;

means for separating said input electrical signal into first and second components, said first component including primarily those audio frequencies, which when reproduced acoustically, provide a binaural time displacement which can be unambiguously perceived by said listener, said second component comprising primarily those audio frequencies which when reproduced acoustically provide a binaural time displacement, the perception of which by said listener tends not to be unambiguous;

means for delaying for a predetermined period of time said first component with respect to said second component so as to provide at least one delayed signal;

means for combining said time delayed signal with said second component to provide a combined signal; and a loudspeaker system having a plurality of spatially separable speaker means, at least one of said speaker means being connected to be driven by said right channel signal, at least one of said speaker means being connected to be simultaneously driven by said left channel signal, and at least one of said speaker means being connected to be simultaneously driven by said combined signal.

22. For use with an acoustic signal reproduction system having within an enclosed listening space at least two spatially separated speaker means for reproducing acoustic waves from corresponding electrical signals, apparatus for providing output electrical signals to drive one of said speaker means so that when the other of said speaker means is simultaneously driven by other electrical signals, said speaker means produce acoustic waves which tend to simulate the ambience of a space larger than the actual enclosed listening space, the input electrical signals for said apparatus being derived from said other signals; said apparatus comprising, in combination:

means for separating each of said input electrical signals into first and second components so that said first component includes primarily relatively low audio frequencies, and said second component includes primarily relatively high audio frequencies, means for delaying for a predetermined period of time said first component with respect to said component so as to provide a time-delayed signal; and means for combining said time-delayed signal with said second component to provide a combined signal as said output electrical signal of said apparatus.

* * * * *

UNITED STATES PATENT OFFICE
CERTIFICATE OF CORRECTION

PATENT NO. : 4,039,755

DATED : August 2, 1977

INVENTOR(S) : Robert A. Berkovitz

It is certified that error appears in the above-identified patent and that said Letters Patent are hereby corrected as shown below:

Claim 22, column 14, line 7, please insert

--second-- after "said" (second occurence).

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*